US009895013B2

(12) United States Patent
Walter

(10) Patent No.: US 9,895,013 B2
(45) Date of Patent: Feb. 20, 2018

(54) DRINKING CONTAINERS WITH ICE RETAINING FEATURES

(71) Applicant: Keith Walter, Lewisville, NC (US)

(72) Inventor: Keith Walter, Lewisville, NC (US)

( * ) Notice: Subject to any disclaimer, the term of this patent is extended or adjusted under 35 U.S.C. 154(b) by 22 days.

(21) Appl. No.: 15/002,067

(22) Filed: Jan. 20, 2016

(65) Prior Publication Data

US 2016/0206122 A1 Jul. 21, 2016

Related U.S. Application Data

(60) Provisional application No. 62/105,485, filed on Jan. 20, 2015.

(51) Int. Cl.
*A47G 19/22* (2006.01)

(52) U.S. Cl.
CPC ..... *A47G 19/2211* (2013.01)

(58) Field of Classification Search
CPC A47G 19/2211; A47G 19/2272; A47G 19/12; Y10T 24/13; Y10T 24/44923; B65D 83/005
See application file for complete search history.

(56) References Cited

U.S. PATENT DOCUMENTS 2,753,050 A 7/1956 Langston
3,549,049 A * 12/1970 Weber ..... B67B 7/26 222/91
4,768,674 A * 9/1988 Prescott ..... A47G 19/2211 220/719
4,842,157 A * 6/1989 Stone-Parker ..... A47G 19/16 220/719
4,938,375 A 7/1990 Fantacone
4,938,377 A * 7/1990 Jarvis ..... A47G 19/12 220/216
5,370,258 A * 12/1994 Fair ..... B65D 25/02 220/501
5,727,712 A 3/1998 Costello
5,860,558 A 1/1999 Fahy
5,971,202 A 10/1999 Filbrun
6,247,212 B1 6/2001 Grana Iglesias
8,459,870 B2 * 6/2013 Katada ..... B65D 33/2508 383/61.2
9,022,250 B2 * 5/2015 Stern ..... A47G 19/2205 220/719
2011/0240664 A1 10/2011 Liggens
2015/0202554 A1 * 7/2015 Ben-Ezra ..... A47G 19/2211 210/443

* cited by examiner

*Primary Examiner* — Shawn M Braden
(74) *Attorney, Agent, or Firm* — Myers Bigel, P.A.

(57) ABSTRACT

A drinking container includes a base and a sidewall extending upwardly from the base. The base and the sidewall define a cavity. The drinking container includes an ice retaining structure in the cavity, with the ice retaining structure including a ring member held adjacent an inner surface of the sidewall. The ring member and the sidewall define at least one laterally extending gap therebetween. The ice retaining structure is positioned and configured to retain ice in the cavity and to permit liquid to pass through the at least one gap when the drinking container is tilted relative to vertical.

13 Claims, 10 Drawing Sheets

DRINKING CONTAINERS WITH ICE RETAINING FEATURES

RELATED APPLICATIONS

This application claims priority from U.S. Provisional Application No. 62/105,485, filed Jan. 20, 2015, the disclosure of which is hereby incorporated herein in its entirety.

BACKGROUND

A common problem associated with the consumption of a beverage containing ice cubes is that the ice cubes float on the surface of the beverage and therefore come in contact with the lips and/or mustache of the drinker. In addition to this problem, the ice cubes often substantially impede the flow of the beverage into the drinker's mouth, frustrating the drinker's desire simply to drink the beverage, rather than maneuver around the ice cubes with his or her lips. When one tilts the glass to enhance the flow of liquid, the ice may come rushing toward the drinker, spilling the contents of the container on the drinker, particularly when the drinker is attempting to consume the final sip or two of the beverage and tilts the container at a high angle relative to vertical. This may be especially frustrating and wasteful when the beverage is an expensive liquor, such as certain scotches or tequilas. Alternatively, a straw can be used but that is less desirable for some and potentially wasteful. Many straws are not environmentally friendly.

SUMMARY

According to some embodiments of the present invention, a drinking container includes a base and a sidewall extending upwardly from the base. The base and the sidewall define a cavity. The drinking container includes an ice retaining structure in the cavity, with the ice retaining structure including a ring member held adjacent an inner surface of the sidewall. The ring member and the sidewall define at least one laterally extending gap therebetween. The ice retaining structure is positioned and configured to retain ice in the cavity and to permit liquid to pass through the at least one gap when the drinking container is tilted relative to vertical.

In some embodiments, the ring member is connected to and/or abuts the sidewall at a plurality of spaced apart locations about the sidewall, and the at least one gap is a plurality of gaps defined by the ring member and the sidewall, with one gap each between adjacent spaced apart locations. The sidewall may be polygonal and the ring member may be circular. The inner surface of the sidewall may be circular and an outer surface of the ring member may be polygonal. The sidewall may be circular and the ring member may be circular, and the ice retaining structure may include a plurality of bridge segments connecting the ring member to the sidewall at the plurality of spaced apart locations.

In some embodiments, the ring member defines a center opening that is sized and configured to receive ice cubes therethrough. The center opening may have a diameter and/or a width of 1 to 3 inches. The center opening may a diameter and/or a width of at least 2 inches (e.g., to allow ice of various sizes and shapes to enter the cavity).

In some embodiments, the sidewall extends upwardly from the base and terminates in a lip, and the ice retaining structure is positioned and configured to retain ice in the cavity and to permit liquid to pass through the at least one gap and over the lip when the drinking container is tilted relative to vertical. The ice retaining structure may be positioned closer to the lip than the base.

In some embodiments, the ring member is optically transparent or translucent.

According to some other embodiments of the present invention, a drinking container includes a base and a sidewall extending upwardly from the base. The base and the sidewall define a cavity configured to hold ice and liquid. An ice retaining structure is in the cavity and includes a ring member held adjacent an inner surface of the sidewall. The ice retaining structure and the sidewall define at least one radially extending gap therebetween. The ice retaining structure is positioned and configured to retain the ice in the cavity and to permit the liquid to pass through the at least one gap when the drinking container is tilted relative to vertical.

In some embodiments, the sidewall and the ice retaining structure are integrally formed.

In some embodiments, the ice retaining structure is releasably attachable to the sidewall. The sidewall and/or the ice retaining structure may include at least one attachment feature for releasably attaching the ring member to the sidewall. The at least one attachment feature may include a fastener on one of the sidewall and the ring member and a fastening receiving feature on the other one of the sidewall and the ring member. The ice retaining structure may include at least one bridge or projection extending outwardly from an outer surface of the ring member, and the at least one attachment feature may include at least one ledge or recess in the inner surface of the sidewall that is configured to receive the at least one bridge or projection.

DETAILED DESCRIPTION OF EMBODIMENTS OF THE INVENTION

Figure 1:
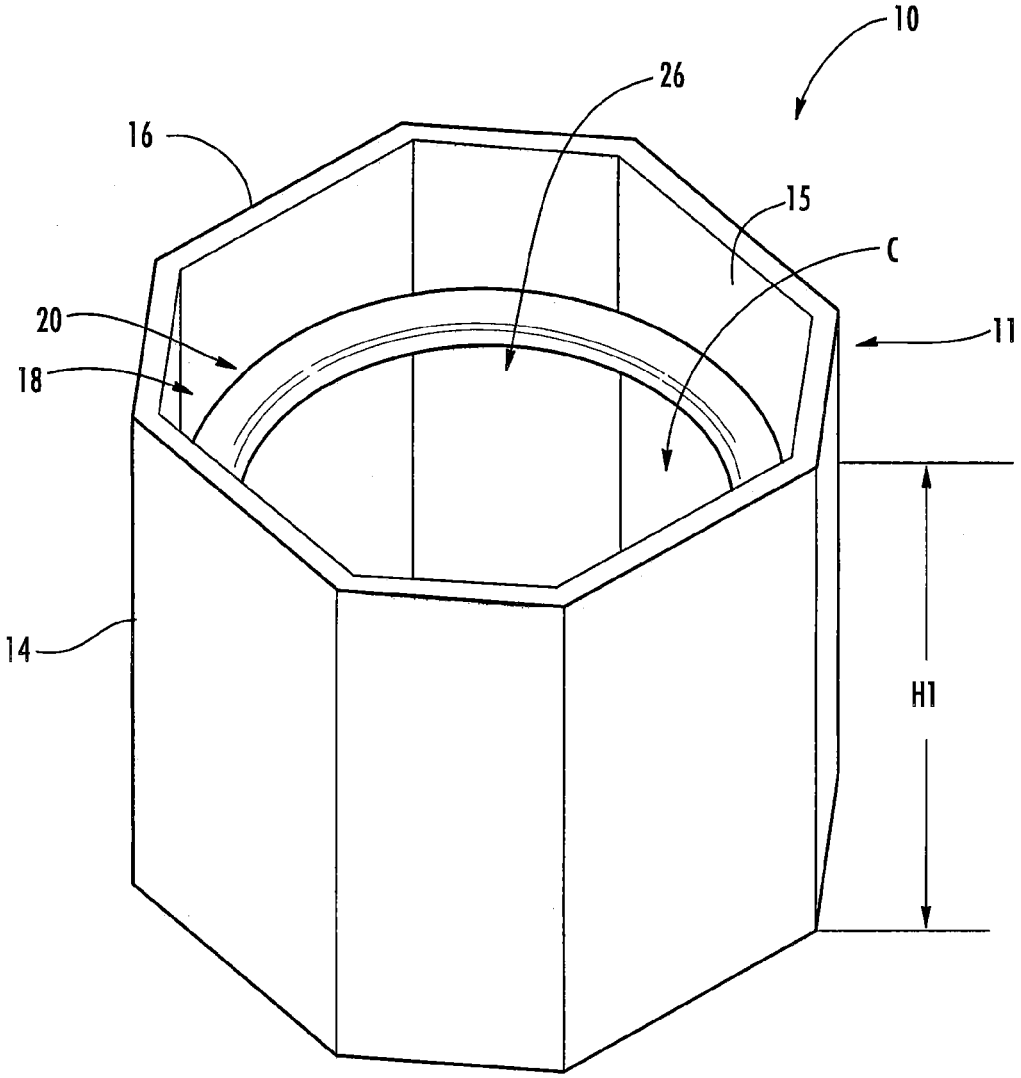
FIG. 1 is a top perspective view of a drinking container according to some embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises," "includes," "comprising," and/or "including," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The terms "glass" and "glasses" as used herein refer to drinking containers that, unless otherwise defined, are not required to be made of glass and may be made of other materials such as various ceramic or polymeric materials.

The term "ice cube" as used herein means a block shaped piece of ice but is not necessarily cube-shaped.

Generally speaking, embodiments of the present invention are directed to containers such as cups and glasses that retain ice while permitting flow of liquid beverage from the container. More specifically, embodiments of the present invention are directed to containers having an ice retaining feature that is configured to retain ice in the container while permitting liquid beverage to flow out of the container when the container is tilted relative to vertical.

Figure 2:
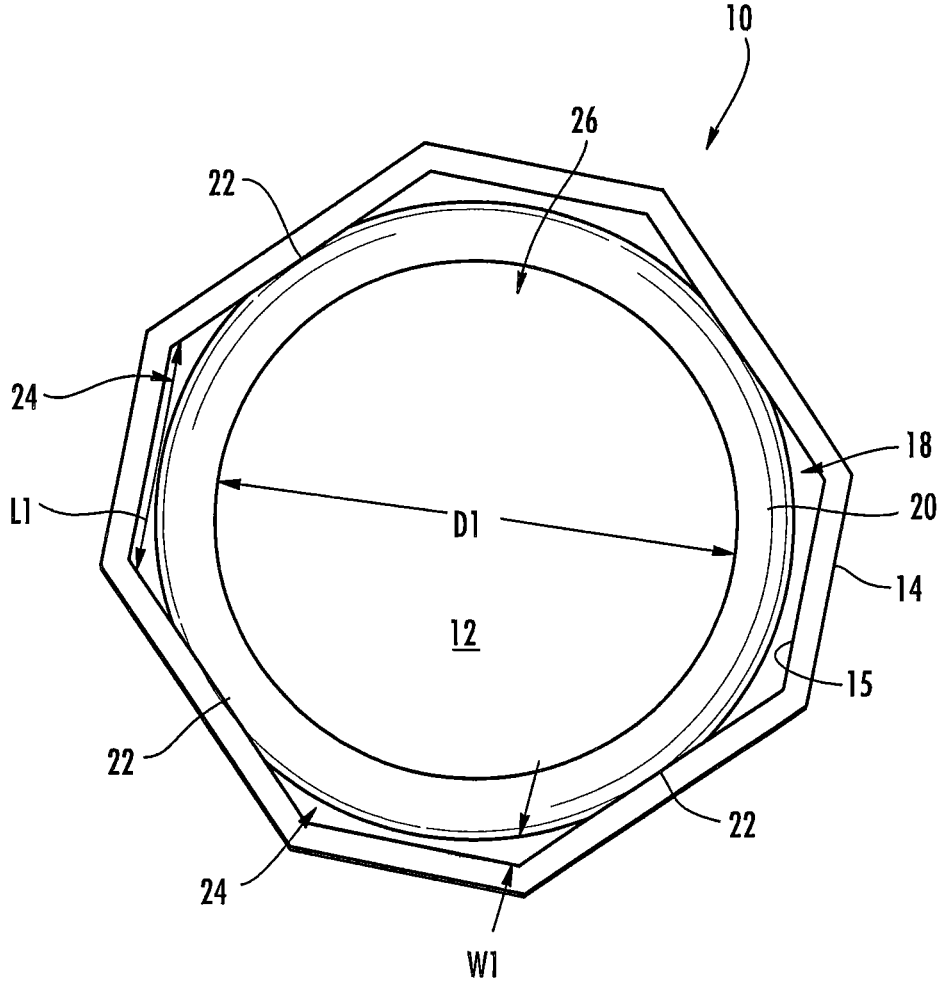
FIG. 2 is a top view of the drinking container of FIG. 1.

A drinking container 10 according to some embodiments is illustrated in FIGS. 1 and 2. The container 10 includes a housing 11. The housing 11 includes a base 12 and a sidewall 14 extending upwardly from the base 12 and terminating in a lip 16. The base 12 and the sidewall 14 define a cavity C. The sidewall 14 can be one continuous member or can be formed by attached members.

An ice retaining structure 18 is in the cavity C. The ice retaining structure 18 includes a ring member 20 held adjacent an inner surface 15 of the sidewall 14. More specifically, the ring member 20 can be connected to and/or abut the sidewall 14 at a plurality of spaced apart locations 22. The ring member 20 and the sidewall 14 can define a plurality of gaps 24 between the locations 22. One of the gaps 24 can be between adjacent spaced apart locations 22.

The ring member 20 can be of constant thickness. A respective gap 24 may have an average length L1 of between 0.5 and 2.5 inches or between 1 and 2 inches in various embodiments. A respective gap 24 may have an average width or thickness W1 of between 0.1 and 0.5 inches or between 0.1 and 0.25 inches in various embodiments.

As will be described in more detail below, the ring member 20 is positioned and configured to retain ice in the cavity C and to permit liquid beverage to pass through at least one of the gaps 24 when the drinking container 10 is tilted. As will also be described in more detail below, the ring member 20 defines a center opening 26 through which ice cubes (or a single large ice cube or sphere) may be inserted downwardly into the cavity C.

The container 10 has a height H1. The height H1 may between 3 inches and 5 inches, making the container 10 suitable for use as a cocktail glass, a rocks glass or a liquor glass.

Figure 3:
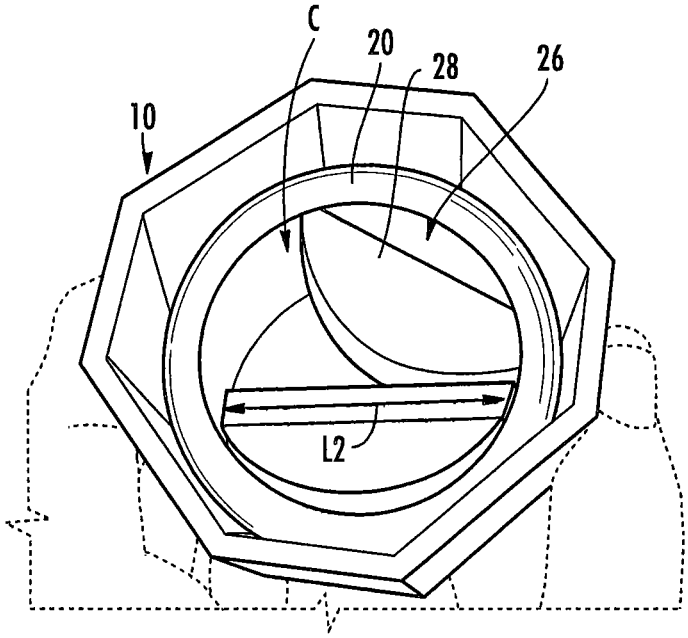
FIG. 3 illustrates the drinking container of FIG. 1 held in a generally vertical orientation.
Figure 4:
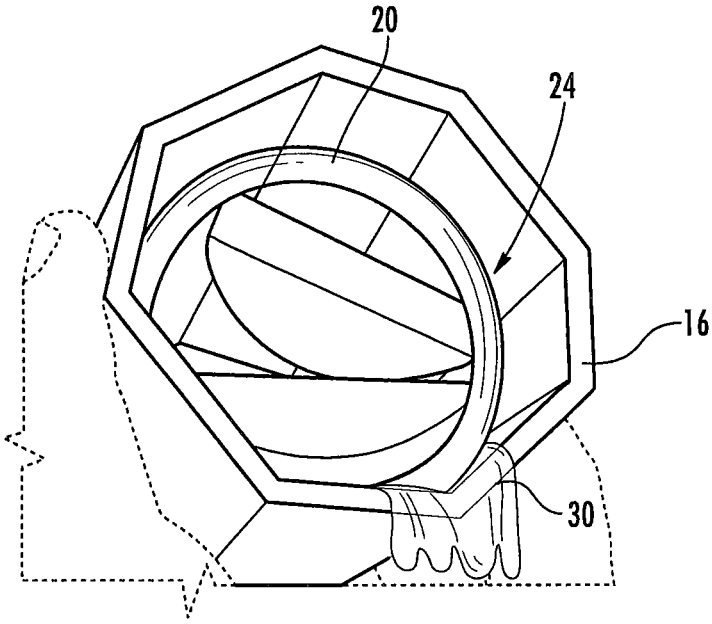
FIG. 4 illustrates the drinking container of FIG. 1 tilted relative to vertical, illustrating an ice retaining feature that retains ice in the container and allows flow of liquid beverage out of the container.

FIG. 3 is a digital image illustrating the drinking container 10 held upright (e.g., in a vertical orientation). Ice cubes 28 and liquid beverage are held in the cavity C below the ring member 20. FIG. 4 is a digital image illustrating the drinking container 10 tilted relative to vertical. As shown, the ring member 20 is positioned and configured such that the ice cubes 28 are retained in the cavity C below the ring member 20 and liquid beverage 30 passes through one of the gaps 24 and over the sidewall lip 16 when the container 10 is adequately tilted relative to vertical. A drinker may tilt the container 10 up to about 90 degrees or more relative to vertical such that substantially all the liquid beverage 30 flows out of the container 10 while the ice cubes 28 are retained in the container 10 by the ring member 20.

As shown in FIG. 3, the center opening 26 defined by the ring member 20 is sized and configured to receive ice cubes therethrough. The opening 26 has a diameter D1 (FIG. 2). In various embodiments, the diameter D1 may be between 1 and 3 inches such as at least 1.5 inches, at least 2 inches and at least 2.5 inches. Thus, the opening 26 is sized to receive relatively large ice cubes. For example, the opening 26 may be sized to receive ice cubes lengthwise that are produced by many ice makers that have a length dimension L of about 1.5 inches. The opening 26 may be sized to receive oversized "cocktail" ice cubes that have a side dimension of 2 inches or more.

Figure 5:
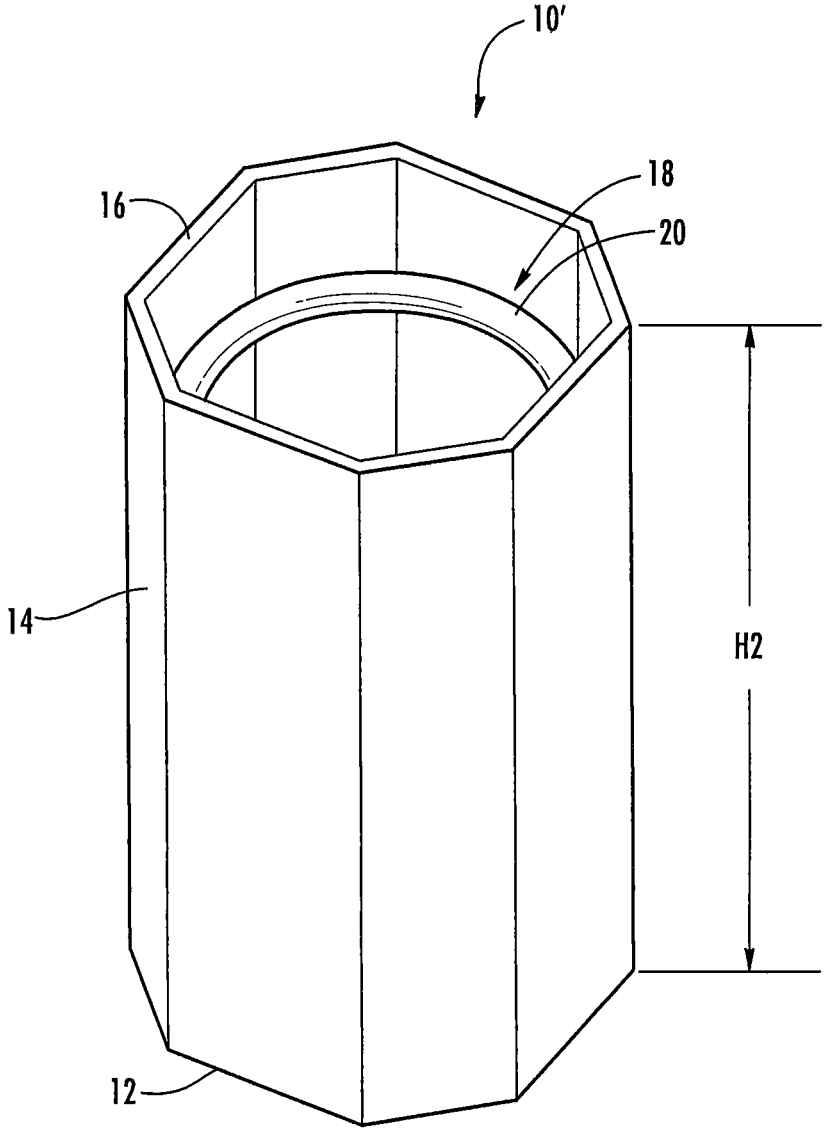
FIG. 5 is a top perspective view of a drinking container according to some other embodiments of the present invention.

Another embodiment of a drinking container 10' is illustrated in FIG. 5. The drinking container 10' is the same as the drinking container 10 except that the sidewalls 14 have a height H2 that is greater than the height H1 of the container 10. The height H2 may be between 5 inches and 7 inches, making the container 10' suitable for use as a highball glass or a glass for ice tea, soda and the like. Like with the container 10, the ring member 20 may be positioned closer to the sidewall lip 16 than the base 12. In some embodiments, the ring member 20 is below but adjacent the lip 16.

As illustrated, the containers 10 and 10' can have octagon-shaped sidewalls 14 and circular ring members 20. That is, the sidewalls 14 can have an octagonal cross section in a plane parallel to the base 12. Drinking containers of different shapes are contemplated. For example, the sidewalls 14 may have a different polygon shape, such as a hexagon or a square, with the ring member being circular.

Figure 6:
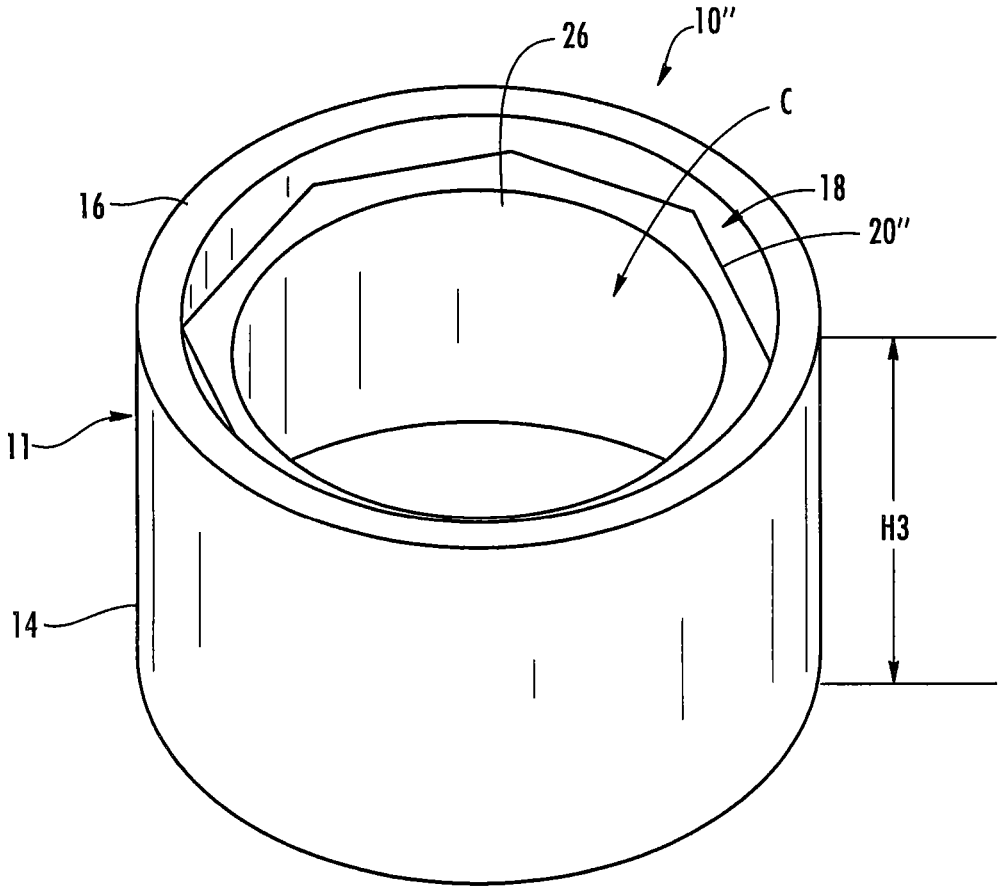
FIG. 6 is a top perspective view of a drinking container according to some other embodiments of the present invention.
Figure 7:
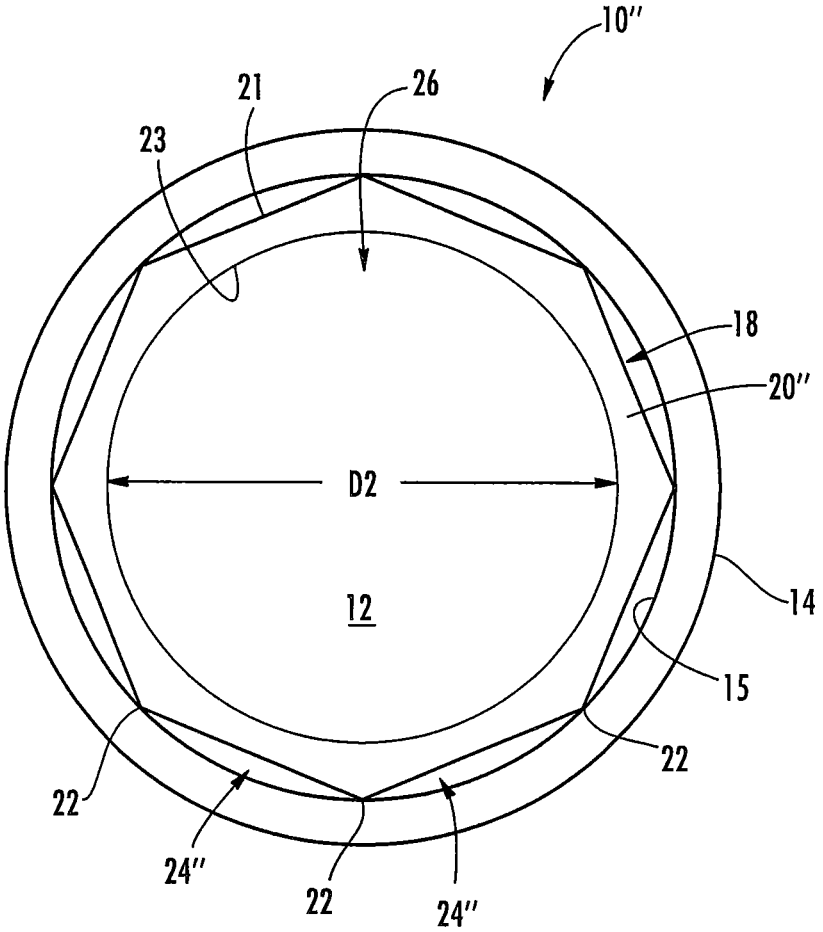
FIG. 7 is a top view of the drinking container of FIG. 6.

Alternatively, as illustrated in FIGS. 6 and 7, a drinking container 10" includes a housing 11 including a circular base 12 and a circular sidewall 14 extending upwardly from the base 12 and terminating in a lip 16. A ring member 20" includes an outer perimeter surface 21 that defines a polygon. As illustrated, the outer surface 21 has a perimeter that is an octagon, although it will be appreciated that the outer surface may define some other type of polygon, such as a hexagon.

Like the ring member 20 of the container 10, the ring member 20" of the container 10" can be connected to and/or abut the sidewall 14 at a plurality of spaced apart locations 22. The ring member 20" and the sidewall 14 define a plurality of gaps 24" therebetween. One of the gaps 24" is between adjacent ones of the spaced apart locations 22. The ring member 20" is positioned and configured to retain ice in the cavity C (defined by the housing 11 and, more specifically, by the base 12 and the sidewall 14) and to permit liquid beverage to pass through at least one of the gaps 24" when the drinking container 10" is tilted. The gaps 24" may have the same dimensions as the gaps 24 of the container 10 described above.

An inner surface 23 of the ring member 20" defines a circular center opening 26. The opening has a diameter D2. The diameter D2 may have the same dimensions as the diameter D1 described above in reference to the container 10, and therefore may advantageously allow relatively large pieces of ice to pass therethrough and into the cavity C.

The container 10" has a height H3. The height 113 may have the same dimensions as the height H1 described above in reference to the container 10 or the height H2 described above in reference to the container 10'.

Figure 8:
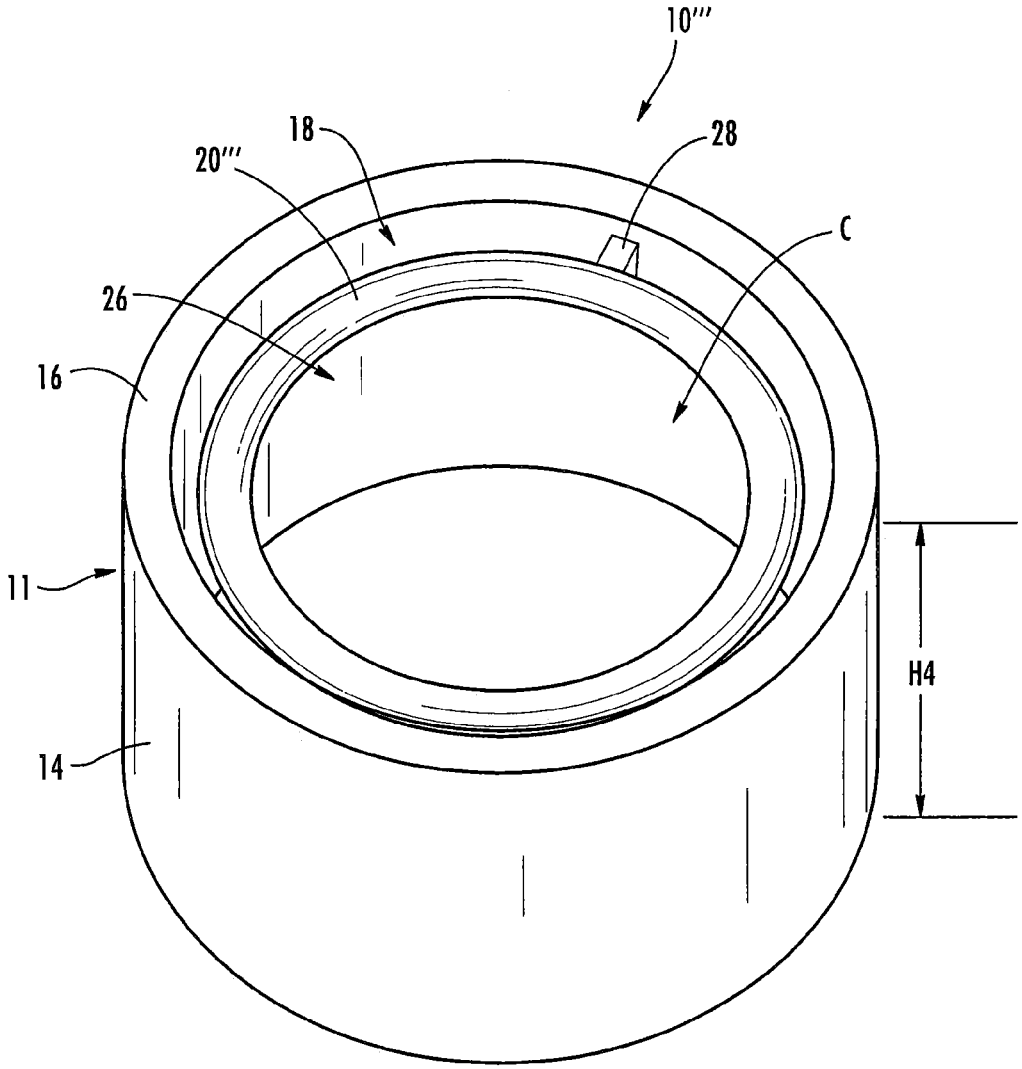
FIG. 8 is a top perspective view of a drinking container according to some other embodiments of the present invention.
Figure 9:
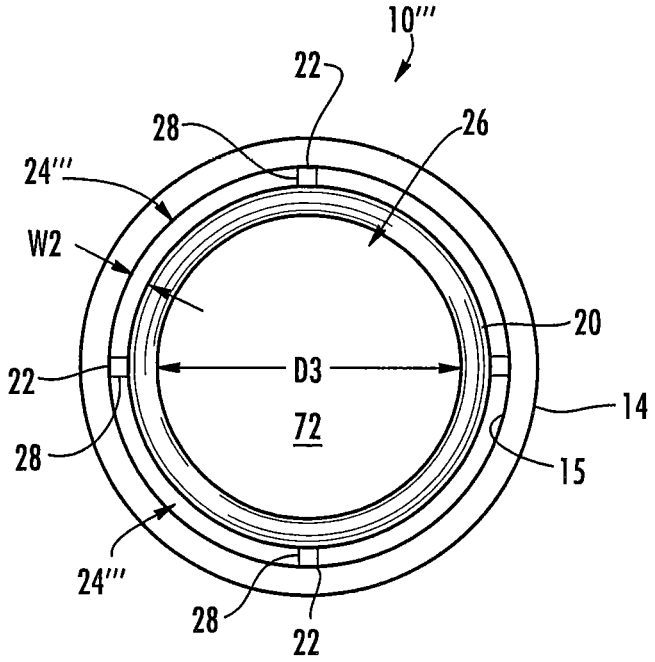
FIG. 9 is a top view of the drinking container of FIG. 8.

Turning to FIGS. 8 and 9, a drinking container 10"' according to some other embodiments includes a housing 11 including a circular base 12 and a circular sidewall 14 extending upwardly from the base 12 and terminating in a lip 16. The ice retaining structure 18 includes a circular ring member 20''' and at least one bridge segment 28 that connects the ring member 20 to the sidewall 14. As illustrated in FIG. 9, a plurality of bridge segments 28 may be used to connect the ring member 20''' to an inner surface 15 of the sidewall 14 at a plurality of spaced apart locations 22. The sidewall inner surface 15, the ring member 20''' and the bridge segments 28 define a plurality of gaps 24''' therebetween with gaps 24''' and bridge segments 28 alternating about the perimeter of the interface between the ring member 20''' and the sidewall inner surface 15. One of the gaps 24''' is between adjacent bridge segments 28.

The bridge segments 28 can be generally equally spaced apart. As illustrated in FIG. 9, the bridge segments 28 are radially spaced apart by 90 degrees. In various other embodiments, the bridge segments can be radially spaced apart by 180, 135, 60, 45 or 30 degrees or less. The gaps 24''' can have a uniform width or thickness W2 of between 0.1 and 0.5 inches or between 0.1 and 0.25 inches in various embodiments.

The ice retaining structure 18 is positioned and configured to retain ice in the cavity C (defined by the housing 11 and, more specifically, by the base 12 and the sidewall 14) and to permit liquid beverage to pass through at least one of the gaps 24''' and over the lip 16 when the drinking container 10''' is tilted relative to vertical (e.g., when a drinker tilts the container 10''' to his or her lips).

The ring member 20''' defines a circular center opening 26. The opening has a diameter D3. The diameter D3 may have the same dimensions as the diameter D1 described above in reference to the container 10, and therefore may advantageously allow relatively large pieces of ice to pass therethrough and into the cavity C.

The container 10''' has a height 114. The height 114 may have the same dimensions as the height H1 described above in reference to the container 10 or the height 112 described above in reference to the container 10'.

The drinking containers described herein may be formed of any suitable material for a drinking container. In some embodiments, the drinking container is formed of a rigid or semi-rigid material that is suitable for a formal drinking container such as a cocktail glass.

In some embodiments, the drinking container is glass and may be formed by melting and forming (e.g., blowing or molding) as understood by those skilled in the art. In some other embodiments, the drinking container is plastic and may be formed by melting and molding (e.g., compression molding or injection molding) as understood by those skilled in the art. In some other embodiments, the drinking container is formed by additive manufacturing, commonly known as 3D printing. In some other embodiments, the drinking container is metal. For example, the drinking container may be copper and resemble a "Moscow Mule" cup or mug. In some other embodiments, the drinking container is formed of more than one material. By way of example, the housing may be glass and the ice retaining structure may be plastic or vice versa. By way of further example, the housing may be glass and the ice retaining structure may be metal or vice versa.

The ice retaining structure or ring member may be integrally formed with the drinking container housing or may be separately formed. Using the drinking container 10 of FIGS. 1 and 2 as an example, the housing 11 and the ring member 20 may be integrally formed, such as by using the processes described above. Alternatively, the ring member 20 may be formed separately and may then be adhered or otherwise attached or connected to the sidewall 14. In some embodiments, the sidewall 14 may include connection features and the ring member 20 may be releasably connected to the sidewall 14 using the connection features or vice versa. In the embodiments of FIGS. 8 and 9, the bridge segments 28 may include a connection feature, and the ring member 20''' may be releasably connected to the rest of the container 10''' using the connection features.

Figure 10:
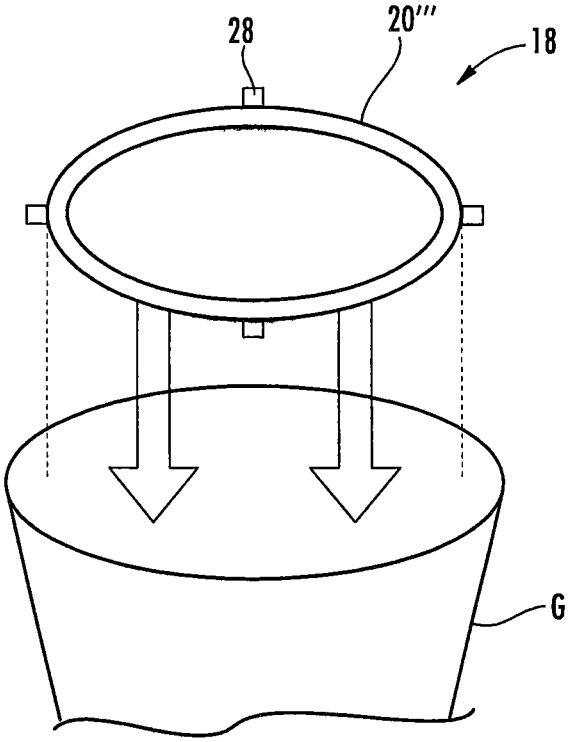
FIG. 10 is a schematic illustration of an ice retaining structure being inserted into a glass according to some embodiments of the present invention.

If the ring member is separately formed, the ring member may also be received and held in the container cavity by an interference fit. For example, the container sidewalls may flare outwardly from the base to the lip (e.g., as with a common pint glass), and the ring member may be received and held in the container cavity by an interference fit at a desired height or level, as generally illustrated in FIG. 10 with the ice retaining structure 18 including the ring member 20''' and the bridge segments 28 being inserted into a glass G.

The ring member may have substantially the same appearance and/or color as the rest of the container, which may help obscure the ring member. The ring member and/or the container housing may be transparent or semi-transparent, also helping to obscure the ring member. Moreover, the ring member generally resides adjacent to the inner sidewall and defines a relatively large center opening, and therefore the ring member is relatively unobstructive and can be hidden from view by others.

The diameter or width of the center opening defined by the ring member may be large relative to the diameter or width of the container housing. For example, referring to FIGS. 1 and 2, the diameter D1 of the center opening 12 may be at least 70% the (outer) width of the housing 11.

Figure 11:
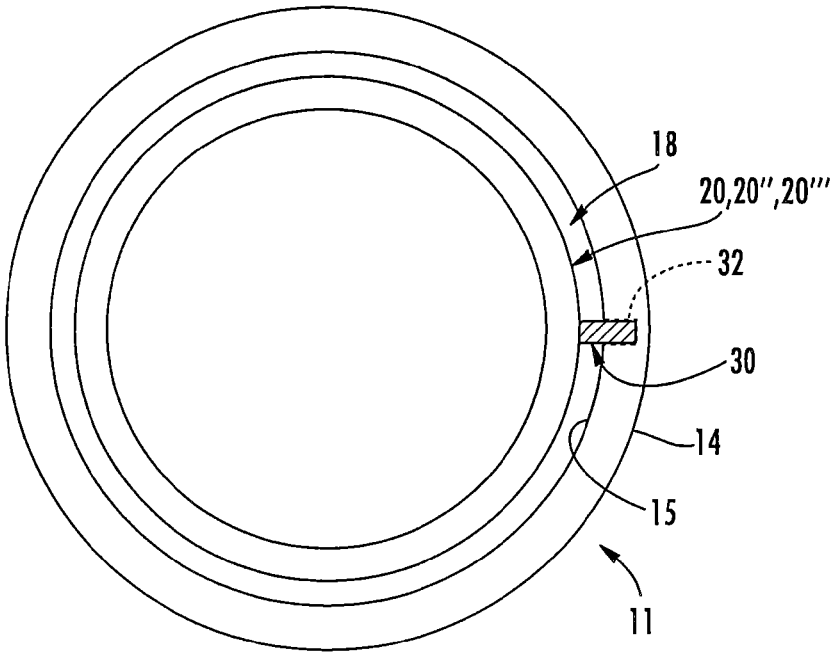
FIGS. 11 and 12 are top views of ice retaining structures that can be releasably coupled to drinking container housings according to some embodiments of the present invention.
Figure 12:
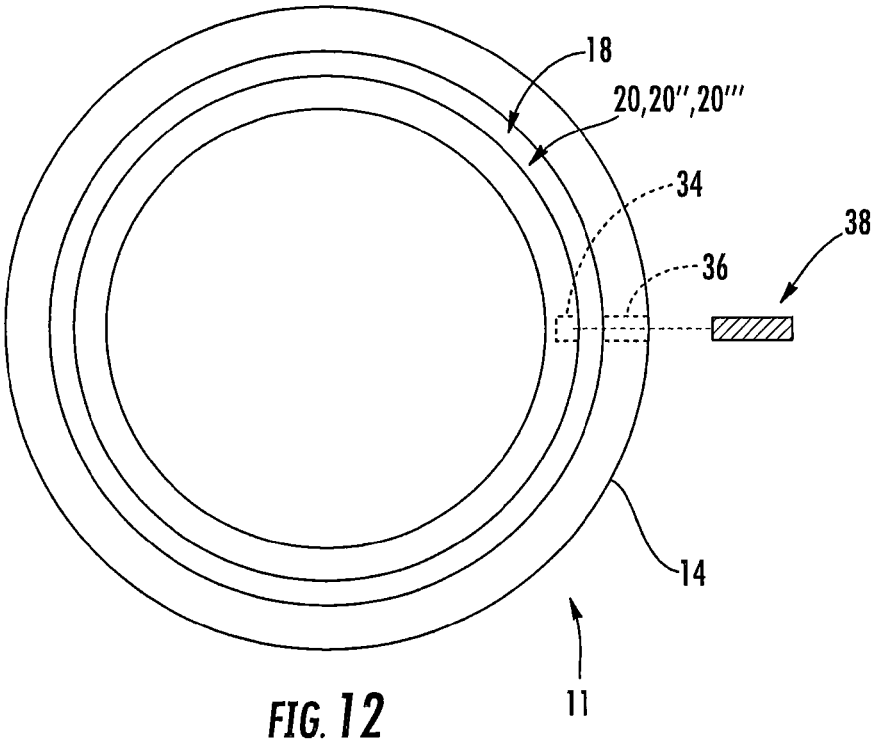

As described above, the ice retaining structure 18 may be integrally formed with the housing sidewall 14 or may be releasably coupled to the housing sidewall 14. FIGS. 11 and 12 illustrate two example two-piece arrangements that allow the ice retaining structure 18 to be releasably coupled to the housing sidewall 14.

As shown in FIG. 11, the sidewall 14 of the housing 11 and the ice retaining structure 18 each include at least one attachment feature for attaching the ice retaining structure 18 to the housing sidewall 14. As illustrated, the ice retaining structure 18 includes at least one fastener or projection 30 that extends outwardly away from the ring member 20 and the inner surface 15 of the housing sidewall 14 has at least one fastener or projection receiving feature 32 defined therein that is configured to receive the fastener or projection 30. By way of example, the fastener 30 may be a screw or other threaded fastener and the fastener receiving feature 32 may be a threaded passageway configured to receive the screw to hold the ice retaining structure 18 in place. By way of further example, the projection receiving feature 32 could be a ledge, notch and/or recess that is configured to receive the projection 30 to hold the ice retaining structure 18 in place (e.g., the ice retaining structure 18 may be snapped into place using the projection 30 and the ledge, notch and/or recess 32).

It is contemplated that the ice retaining structure 18 may include a plurality of radially spaced apart fasteners or projections 30 and the inner surface 15 of the housing sidewall 14 may include a corresponding number of fastener or projection receiving features 32 configured to receive the fasteners or projections 30 to hold the ice retaining structure 18 in place. It is also contemplated that at least one fastener or projection 30 may extend inwardly from the housing sidewall 14 and that the ice retaining structure 18 may include at least one fastener or projection receiving feature 32 configured to receive the at least one fastener 30 to hold the ice retaining structure 18 in place.

Referring to FIG. 12, the ring member 20 may have at least one passageway 34 extending at least partially therethrough and at least one through passageway 36 may be defined through the housing sidewall 14. The passageways 34, 36 may be aligned and a fastener 38 may be received through the aligned passageways 34, 36 to hold the ice retaining structure 18 in place. According to some embodiments, the passageways 34, 36 are threaded and the fastener 38 is a threaded fastener (e.g., a screw) that is configured to threadingly engage the passageways 34, 36.

It is contemplated that the ice retaining structure 18 may include a plurality of radially spaced apart passageways 34 and the housing sidewall 14 may include a corresponding number of passageways 36. Corresponding ones of the passageways 34, 36 may be aligned and a fastener 38 may be received through each set of aligned passageways 34, 36 to hold the ice retaining structure 18 in place. It is also contemplated that the at least passageway 34 may extend from the inner surface 15 of the housing sidewall 14 at least partially through the housing 14 and that the at least one through passageway 36 may extend through the ring member 20. The passageways 34, 36 may be aligned and receive fastener(s) 38 therethrough to hold the ice retaining structure 18 in place.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

What is claimed is:

1. A drinking container comprising:

a base;

a sidewall extending upwardly from the base, wherein the base and the sidewall define a cavity; and an ice retaining structure in the cavity, the ice retaining structure consisting of a ring member held adjacent an inner surface of the sidewall;

wherein the ice retaining structure and the sidewall define at least one laterally extending gap therebetween, and wherein the ice retaining structure is positioned and configured to retain ice in the cavity and to permit liquid to pass through the at least one gap when the drinking container is tilted relative to vertical.

2. The drinking container of claim 1 wherein the ring member is connected to and/or abuts the sidewall at a plurality of spaced apart locations about the sidewall, wherein the at least one gap is a plurality of gaps defined by the ring member and the sidewall, one gap each between adjacent spaced apart locations.

3. The drinking container of claim 2 wherein the sidewall is polygonal and the ring member is circular.

4. The drinking container of claim 2 wherein the inner surface of the sidewall is circular and an outer surface of the ring member is polygonal.

5. The drinking container of claim 1 wherein the ring member defines a center opening that is sized and configured to receive ice cubes therethrough.

6. The drinking container of claim 5 wherein the center opening has a diameter and/or a width of 1 to 3 inches.

7. The drinking container of claim 5 wherein the center opening has a diameter and/or a width of at least 2 inches.

8. The drinking container of claim 1 wherein the sidewall extends upwardly from the base and terminates in a lip, and wherein the ice retaining structure is positioned and configured to retain ice in the cavity and to permit liquid to pass through the at least one gap and over the lip when the drinking container is tilted relative to vertical.

9. The drinking container of claim 8 wherein the ice retaining structure is positioned closer to the lip than the base.

10. The drinking container of claim 1 wherein the ring member is optically transparent or translucent.

11. A drinking container comprising:

a base;

a sidewall extending upwardly from the base, wherein the base and the sidewall define a cavity configured to hold ice and liquid; and an ice retaining structure in the cavity, the ice retaining structure consisting of a ring member held adjacent an inner surface of the sidewall;

wherein the ice retaining structure and the sidewall define at least one radially extending gap therebetween, and wherein the ice retaining structure is positioned and configured to retain the ice in the cavity and to permit the liquid to pass through the at least one gap when the drinking container is tilted relative to vertical.

12. The drinking container of claim 11 wherein the sidewall and the ice retaining structure are integrally formed.

13. The drinking container of claim 11 wherein the ice retaining structure is releasably attachable to the sidewall.

* * * * *